US006422316B1

(12) United States Patent
Schutz et al.

(10) Patent No.: US 6,422,316 B1
(45) Date of Patent: Jul. 23, 2002

(54) MOUNTING SYSTEM FOR OFFSHORE STRUCTURAL MEMBERS SUBJECTED TO DYNAMIC LOADINGS

(75) Inventors: Ronald W. Schutz, Canfield, OH (US); Carl F. G. Baxter, Virum (DK)

(73) Assignee: RTI Energy Systems, Inc., Niles, OH (US)

( * ) Notice: Subject to any disclaimer, the term of this patent is extended or adjusted under 35 U.S.C. 154(b) by 0 days.

(21) Appl. No.: 09/733,438

(22) Filed: Dec. 8, 2000

(51) Int. Cl.[7] ..... E21B 15/02

(52) U.S. Cl. ..... 166/367; 166/351

(58) Field of Search ..... 166/338, 341, 166/342, 349, 367, 77.51, 85.1, 85.5, 88.1, 88.3, 96.1

(56) References Cited

U.S. PATENT DOCUMENTS

| | | | | |
|---|---|---|---|---|
| 3,749,429 A | | 7/1973 | Hauber | |
| 4,097,069 A | * | 6/1978 | Morrill | 285/84 |
| 4,216,834 A | * | 8/1980 | Wardlaw | 175/7 |
| 4,561,499 A | * | 12/1985 | Berner, Jr. et al. | 166/341 |
| 4,776,600 A | | 10/1988 | Kohn | |
| 5,846,028 A | * | 12/1998 | Thory | 405/195.1 |
| 6,032,742 A | * | 3/2000 | Tomlin et al. | 166/345 |

OTHER PUBLICATIONS

Thomas Wallace and Lee Bone, "Practical Innovations Help Solve Operating Problems," *Oil World*, Gulf Publishing Company, Feb. 1995, 3 pages.

John V. Breaker, "Testing and Application of an Improved High Pressure Electrical Insulating Flange Gasket," Paper No. 229, presented at Corrosion 89, Apr. 17–21, 1989, New Orleans, Louisiana, 24 pages.

Brochure: *Flange Insulation & Sealing*, Pikotek PGE, Lakewood, Colorado, 8 pages, admitted prior art.

Brochure: *Ring–Joint Connections*, Pikotek VCS, Lakewood, Colorado, 4 pages, admitted prior art.

Brochure: *The Ultimate in Critical Service Flange Connections*, Pikotek, Lakewood, Colorado, 3 pages, admitted prior art.

* cited by examiner

*Primary Examiner*—Frank S. Tsay
(74) *Attorney, Agent, or Firm*—Browning Bushman P.C.

(57) ABSTRACT

A mounting system for supporting elongate, metallic structural members used in offshore applications and subject to dynamic forces comprising a support assembly having a socket that at least partially encircles the structural member, an attachment for securing the support assembly to a positioned structure, such as an offshore platform, and a sleeve received in the socket, the sleeve being disposed in surrounding relationship to the structural member and comprising an electrically nonconductive, fiber-reinforced polymer composite.

12 Claims, 4 Drawing Sheets

FIG. 5
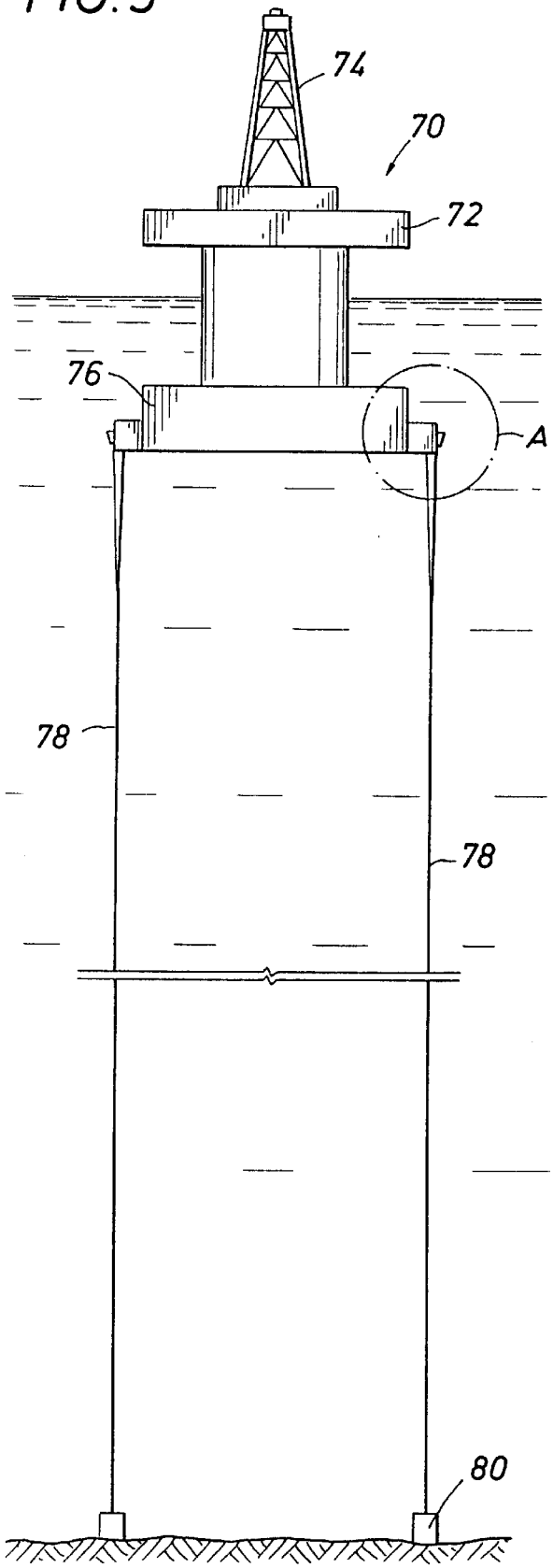
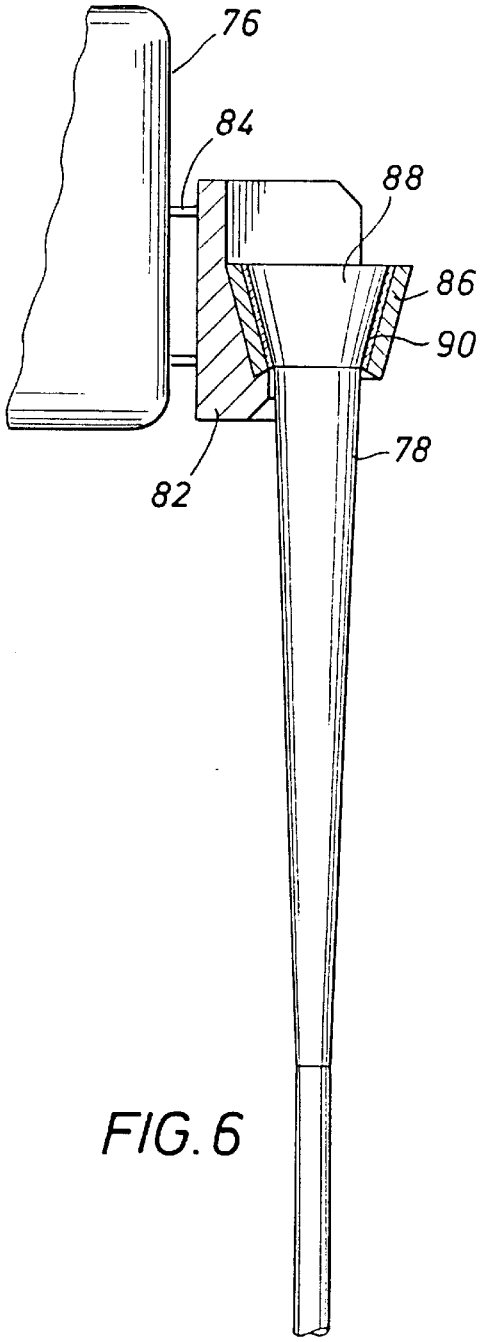
FIG. 6

MOUNTING SYSTEM FOR OFFSHORE STRUCTURAL MEMBERS SUBJECTED TO DYNAMIC LOADINGS

BACKGROUND OF THE INVENTION

1. Field of the Invention

The present invention relates to mounting or support systems and, more particularly, to mounting or support systems for supporting elongate structural members found in offshore applications and subject to dynamic axial and lateral loads.

2. Description of the Prior Art

As the search for oil and gas is extended to progressively deeper offshore waters, greater demands are placed upon the structural components used in those activities. For example, marine riser systems may extend thousands of feet from a wellhead assembly to an offshore platform or vessel. These riser systems, which are sections of tubular components joined together, e.g., by threads, can be subjected to very high dynamic forces that act both axially and laterally on the riser strings. While typically the riser strings are constructed of steel, in an attempt to reduce hang-off loads and/or diminish static and cyclic bending stresses, as well as transmitted moments that generally increase with riser size and/or wave action, titanium alloy components are being incorporated into the riser strings. While steel and other ferrous-based riser strings and offshore components are effectively protected from the effects of corrosive seawater environments by sustained application of cathodic protection, if titanium alloy components are incorporated into the riser strings, it may be necessary to totally isolate impressed cathodic currents/potentials from these components to avoid long-term hydrogen adsorption and damage. Additionally, it is also prudent to preclude the detrimental effects of galvanic coupling between mating or adjoining dissimilar riser system alloys exposed to seawater and/or produced fluid brine through electrical isolation.

For dynamic riser systems, flex joints comprised of interspersed steel and rubber-layer laminate flex elements provide electrical isolation at the riser topside or subsea termination point. Alternative means of electrical isolation in dynamic riser systems using traditional, common electrical insulation materials, such as ceramics and polymers, has been largely unsuccessful because of the undesirable properties offered by these materials. Although ceramics possess elevated compressive strength, they are highly susceptible to physical damage and cracking due to their intrinsic brittleness and low toughness. Additionally, their high stiffness (high modulus) and low shear strength require extremely tight dimensional tolerances and close fit, which are often not achievable in the interface cross-section sizes required in riser systems. Although thermoset and thermoplastic polymers exhibit reasonable ductility, toughness, and durability, and are readily applied as coatings or sheet forms, their compressive bearing, creep, and fatigue strength properties are generally too low for these dynamic systems and rapidly diminish with increasing service temperature.

Over and above the problems of electrically isolating the titanium components from the steel components, dynamic loading on the titanium components can become a severe problem. Typically, elongate titanium alloy structural components, such as risers, are supported by steel support pods or sockets. Because of the cyclic lateral forces exerted on the elongate titanium components, there is a tendency for the titanium components to undergo fretting and fatigue failure generally at the junction of the titanium structural component and the steel support pod or socket. Thus, aside from the problems associated with electrical isolation between the steel components and the titanium components, there is also the problem of diminished fatigue life in the titanium component as a result of fretting at the juncture of the titanium component and the steel support.

SUMMARY OF THE INVENTION

It is therefore an object of the present invention to provide a mounting system for structural members used in offshore applications and subjected to dynamic loading.

Another object of the present invention is to provide a mounting system for elongate structural members used in offshore applications that permits electrical isolation of the structural member from associated structures such as offshore platforms.

Another object of the present invention is to provide a mounting system for supporting elongate structural members used in offshore applications that minimizes fretting of the elongate structural member due to dynamic lateral loading.

The above and other objects of the present invention will become apparent from the drawings, the descriptions given herein, and the appended claims.

In accordance with the present invention, there is provided a mounting system for elongate, metallic structural members used in offshore applications, e.g., titanium tubing, that are subject to dynamic forces. The mounting system includes a support assembly, the support assembly including a socket that at least partially encircles the structural member. There is an attachment for securing the support assembly to a positioned structure such as an offshore platform. A sleeve is received in the socket, the sleeve being disposed in surrounding relationship to the structural member. The sleeve comprises an electrically nonconductive, fiber-reinforced polymer composite having a through-thickness compressive strength above 25 ksi at temperatures at least as high as 120° C. and an S-N fatigue life under cyclic compressive through-thickness loading in excess of 1 million cycles at maximum compressive stress levels of $\leqq 20$ ksi.

BRIEF DESCRIPTION OF THE DRAWINGS

FIG. 1 is an elevational view, partly in section, showing the mounting system of the present invention used to hang off a catenary riser system from an offshore platform;

FIG. 5 is a perspective view of an offshore platform anchored by a tension leg system;

FIG. 6 is an enlargement of the area of FIG. 5 circumscribed by the circle.

DESCRIPTION OF THE PREFERRED EMBODIMENTS

Figure 2:
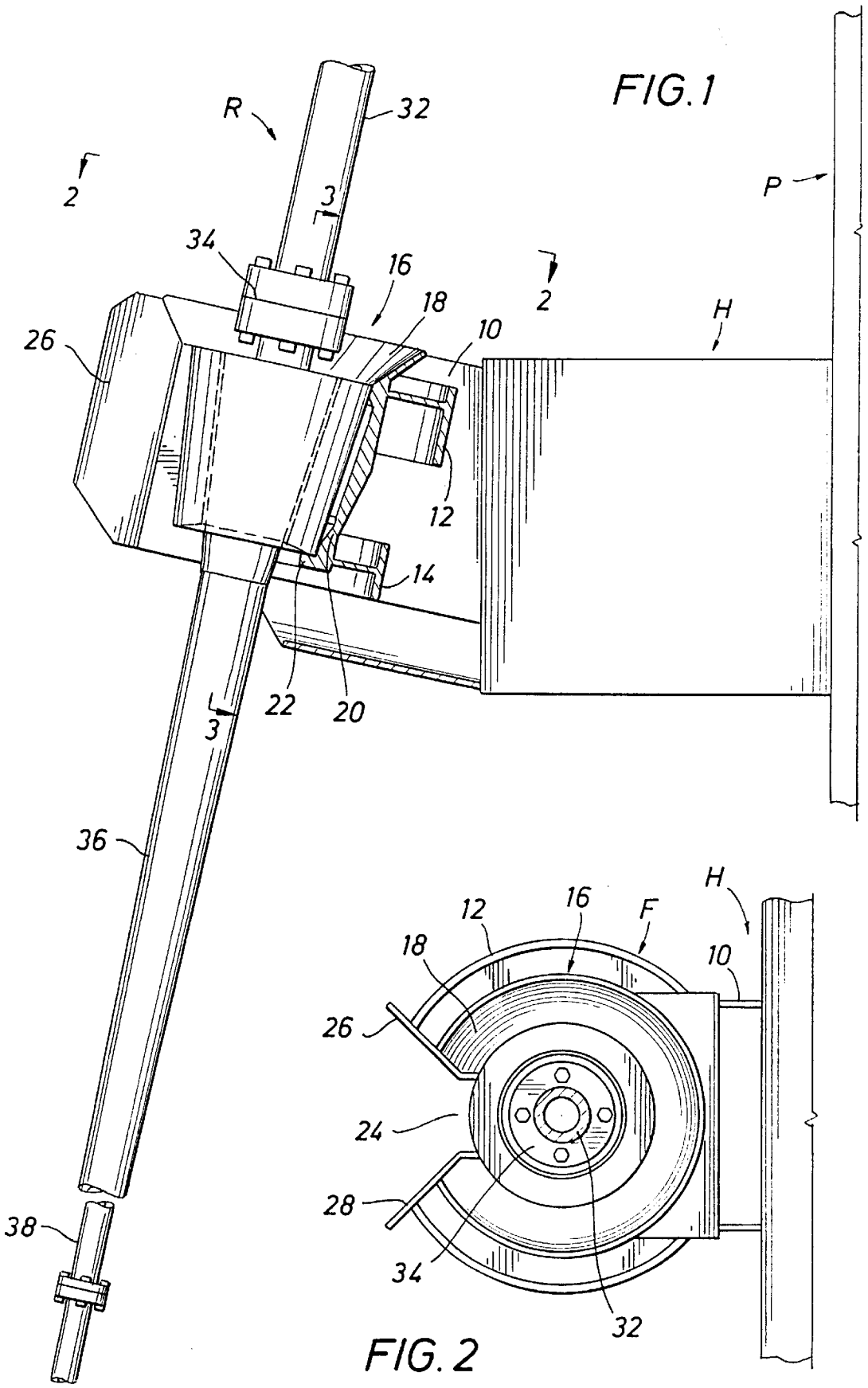
FIG. 2 is a view taken along the lines 2—2 of FIG. 1.

With reference first to FIG. 1, the mounting system of the present invention is shown as being used to support a metallic catenary riser string extending from an offshore platform to a subsea wellhead (not shown). The platform, shown generally as P, has a hull portion, shown generally as H, that is below the seawater surface. Attached to the hull H is a framework, shown generally as F, having a bracket 10 that extends laterally from hull H and to which are secured upper and lower, generally T-shaped members 12 and 14, respectively. Members 12 and 14 partially encircle and are secured to a socket, shown generally as 16. Socket 16 has a first, upper frustoconical wall 18 and a second, lower, generally frustoconical wall 20, frustoconical wall 20 terminating in a radially inwardly extending lip 22. As best seen in FIG. 2, members 12, 14 and socket 16 do not form full annular structures, but rather collectively define a laterally opening slot 24 framed by a pair of guide plates 26 and 28.

Figure 3:
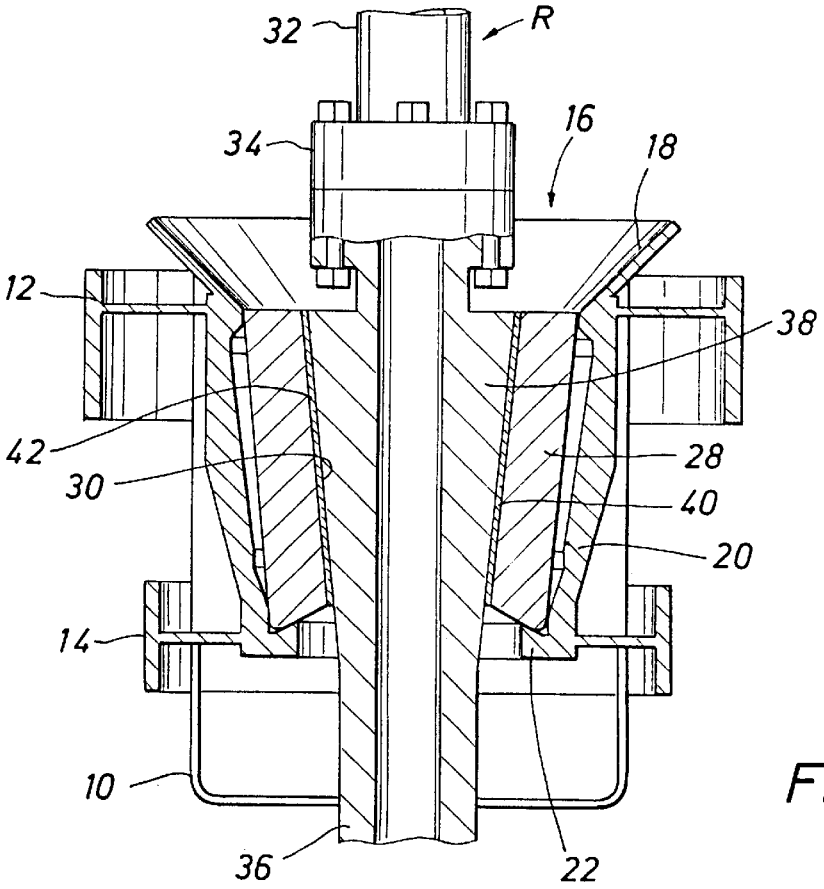
FIG. 3 is a view taken along the lines 3—3 of FIG. 1.

Received in socket 16 is a portion of a riser assembly, shown generally as R. Riser assembly R comprises a section of steel piping 32 that is connected to the top deck (not shown) of platform P. Steel piping 32 is connected via a flange connection 34 to a titanium stress joint 36, which in turn is connected to a steel catenary riser 38 that extends to a subsea wellhead (not shown). As best seen with reference to FIG. 3, a removable clamshell-type bushing 28 surrounds stress joint 36. Bushing 28 also has an inwardly facing frustoconical surface 30. Because of slot 24, it will be seen that the stress joint 36 carrying bushing 28 can be easily inserted into the socket 16 and, once positioned, will be prevented from any downward axial movement, bushing 28 resting on lip 22. As best seen in FIG. 3, titanium stress joint 36 has a tapered upset portion 38, the tapered upset portion 38 having an outer frustoconical surface 40 that is complementary to frustoconical surface 30 formed in bushing 28. Disposed between surface 30 of bushing 28 and surface 40 of stress joint 36 is a sleeve 42 of a polymer composite, described more fully hereinafter. As can be seen, sleeve 42 is essentially sandwiched between stress joint 36 and bushing 28.

It will be understood that the riser assembly R, which may extend for thousands of feet from the hull H of platform P, will be subject to cyclic forces due to current and wave action. Since the stress joint 36 is made of titanium or titanium alloy having a relatively low modulus of elasticity, and the socket 16, including any bushings received therein are made of steel having a relatively high modulus of elasticity, the bending forces acting on the stress joint 36 can cause the stress joint 36 to undergo fretting, generally at the juncture of the titanium stress joint and the steel socket 16, resulting in reduced fatigue life. Additionally, contact of the titanium stress joint with the steel socket could set up a galvanic couple and permit cathodic potentials to be infused on the titanium components. Therefore, it is necessary to electrically isolate the titanium stress joint from the steel socket. According to the present invention, this is accomplished by the use of the sleeve 42, which serves. both as an electrical insulator and an antifretting bearing member.

Sleeve 42 is made of a polymeric composite that is electrically nonconductive and provides a high load-bearing, fatigue-resistant interface between the stress joint and the socket. The polymeric composites used to form the sleeves of the present invention will (a) have a through-thickness (short transverse) compressive strength above 25 ksi to temperatures at least as high as 120° C. and (b) provide an S-N fatigue life under cyclic compressive through-thickness loading in excess of 1 million cycles at maximum compressive stress levels of equal to or less than 20 ksi. Additionally, the material ideally should retain minimum compressive strength and fatigue properties after long-term seawater exposure to temperatures at least as high as 120° C., exhibit insignificant creep under compressive (through-thickness) bearing stresses of equal to or less than 25 ksi to temperatures at least as high as 120° C., and remain durable, monolithic, and electrically nonconductive in seawater up to at least 120° C. over an extended service life.

As used herein, the term "composite" or "composite material" refers to a combination of two or more materials (reinforcements and composite matrix binders) differing in form or composition on a macro scale. The constituents retain their identities-i.e., they do not dissolve or merge completely into one another, although they act in concert. Subject to meeting requirements (a) and (b) above, the composite can be comprised of a reinforcing filler supported in a polymeric matrix selected from the group consisting of thermoplastic resins, thermosetting resins, and mixtures thereof. Non-limiting examples of such thermosetting resins include expoxy resins, bismaleimide resins, polyimide resins, phenolic resins, polyurethanes, etc., and mixtures thereof. Non-limiting examples of thermoplastic resins that can be used in the composites to form the sleeves used in the present invention include polyether etherketones, polyphenylene sulfides, polyetherimides, polyamideimides, polyurethanes, etc., and mixtures thereof. It will also be appreciated that in certain cases it may be possible to use mixtures of thermoplastic and thermosetting resins, just as it is possible to use more than one type of filler or reinforcement in the composites. Preferred resins useful in forming the sleeves of the present invention are those characterized by a high degree of cross-linking (in the case of thermoset resins) and/or crystallinity and high-glass transition temperatures ($T_G$) and heat deflection temperatures (HDT). Typically, $T_G$ and HDT values should exceed about 110° C. to provide sufficient compressive strength and modulus, and creep resistance under the high static and cyclic bearing loads to which the structural members are subjected. Additionally, to resist environmental attack, the composites should be highly resistant to hydrolysis and exhibit minimal water absorption (<0.5 wt. %) to ensure good long-term property retention in seawater up to at least 120° C.

Non-limiting examples of reinforcements include glass fibers, aramid fibers, polybenzimidazole fibers, boron fibers, silicon carbide fibers, aluminum oxide fibers, etc. Preferred fibers are glass or aramid fibers, glass fibers, especially S-2 structural glass fibers, being preferred due to their high strength properties. Furthermore, a high density of continuous filaments is generally preferred over woven, fabric-mat, or short-chopped (random) fibers. An especially preferred composite is a laminate consisting of >50 wt. % (typically 60–75 wt. %) continuous glass fibers in a polyether etherketone matrix. Generally speaking, the fiber-reinforced composites used in making the sleeve of the present invention are laminated with unidirectional (or fabric) layers at discrete angles to one another, such as in plywood, thereby distributing the in-plane load in several directions. These laminated structures can be obtained by hand or machine lay-up and filament winding. In lay-up, material that is usually in prepreg form is cut and laid up, layer by layer, to produce a laminate of the desired thickness, number of plies, and ply orientations. In filament winding, a fiber bundle or ribbon is impregnated with resin and wound upon a mandrel (in this case, the stress joint) to produce the sleeve. It will be understood that filament winding may use wet (or melted) resin or prepreg. In either case, the fiber placement process is followed by some type of cure or molding process.

Sleeve 32 can be formed in several ways. For example, the sleeve can be prefabricated on a mandrel to final shape and high dimensional tolerances and then positioned around the structural member using an environmentally resistant adhesive, e.g., an epoxy-based adhesive. Once the sleeve has been positioned on the structural member, the assembly can then be mated to the socket. Additionally, it is also possible to use the structural member as the mandrel to form the sleeve on the structural member.

In a specific example, a sleeve made of a nine-ply laminate (approximately 1.4 mm thick) comprised of 75 wt. % (61 vol. %) S-2 glass fiber-reinforced continuous glass fibers in a polyether etherketone matrix was formed. It was found that this composite had a $T_g$ of about 143° C., provided exceptional long-term resistance to seawater exposure up to at least 120° C., and had a dielectric constant at 1 MHz, 24° C. of 4.60.

Figure 4:
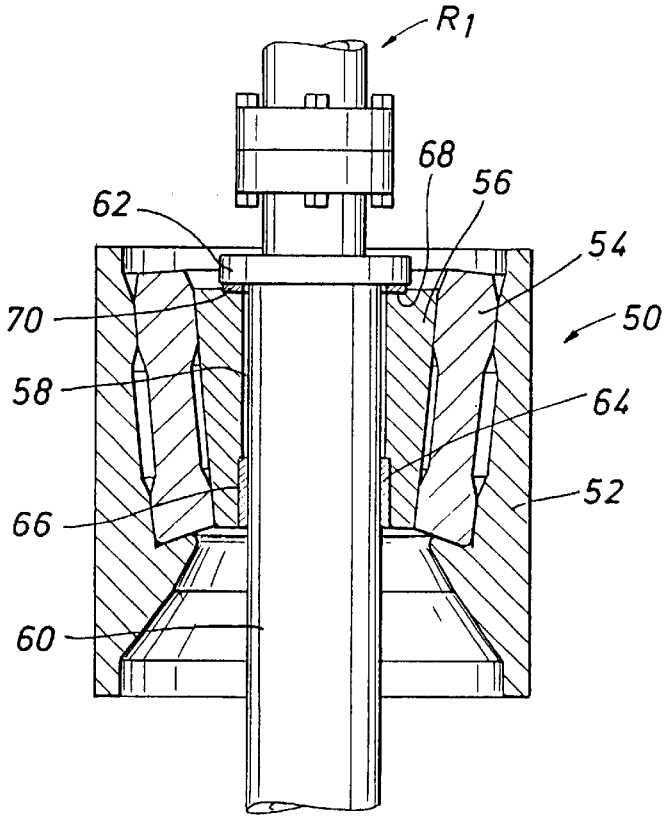
FIG. 4 is a view similar to FIG. 3 showing another embodiment of the mounting system of the present invention wherein an elongate structural member is supported by both horizontal and vertical bearings.

With reference now to FIG. 4, there is shown another embodiment of the present invention wherein a riser string $R_1$ is supported both laterally, or vertically, and horizontally using a sleeve and a bearing made of a composite material according to the present invention. With reference to FIG. 4, a socket, shown generally as 50, comprises an outer or bowl 52 in which is received a bushing 54. Received in bushing 54 is a collar 54 having a bore 58 through which a titanium stress joint 60 extends. Titanium stress joint 60 differs from stress joint 36 in that it is cylindrical rather than having an upset, frustoconical portion, such as 38 on stress joint 36. Stress joint 60 also is provided with a radially outwardly, annularly extending flange 62. Received in a recess 64 of collar 56 is a sleeve 66 made of a composite as described above. Collar 64 is also provided on its upper surface with a counterbore 68 in which is received a bearing 70, bearing 70 being made of a composite material as described above. It can be seen that stress joint 60 is electrically isolated from socket 50 by means of bearing 70 and sleeve 66. Additionally, the fretting of stress joint 60 is minimized by sleeve 66 much in the same manner that sleeve 42 acts to minimize fretting of stress joint 36. It will be appreciated that socket 50 can be attached or secured to a positioned structure, such as an offshore platform, in a manner similar to that described above with respect to the embodiment shown in FIGS. 1–3.

With reference now to FIG. 5, there is shown a perspective view of an offshore platform, shown generally as 70, platform 70 having an upper deck 72 on which is supported a derrick 74. A subsurface deck 76 is tied to tension legs 78, which in turn are secured to anchors or moorings 80 on the seabed. The attachment of tension leg 78 to platform 70 is shown in detail in FIG. 6, FIG. 6 showing an enlargement of the circled area A of FIG. 5. With reference then to FIG. 6, a socket 82 is attached to platform 76 by a suitable mounting bracket 84. Received in socket 82 is a bushing 86 that receives the upper terminus of tension leg 78, tension leg 78 having a flared upper end 88 that has a frustoconical outer surface complementary to a frustoconical inner surface formed in bushing 86. Sandwiched between the frustoconical surface in portion 88 of tension leg 78 and the frustoconical surface of bushing 86 is a frustoconical sleeve 90 made of a composite as describe above. Although sleeve 90 can be used to electrically isolate tension leg 78 from socket 82, such is not normally a consideration since the tension legs 78 are frequently made of a metallic material similar to that of socket 82; however, sleeve 90 serves as a structural member to prevent fretting of tension leg 78 brought on by lateral loading from current or wave action. It will be understood that tension leg 78 can be secured to anchors 80 in the same manner in which it is secured to platform 70.

Figure 7:
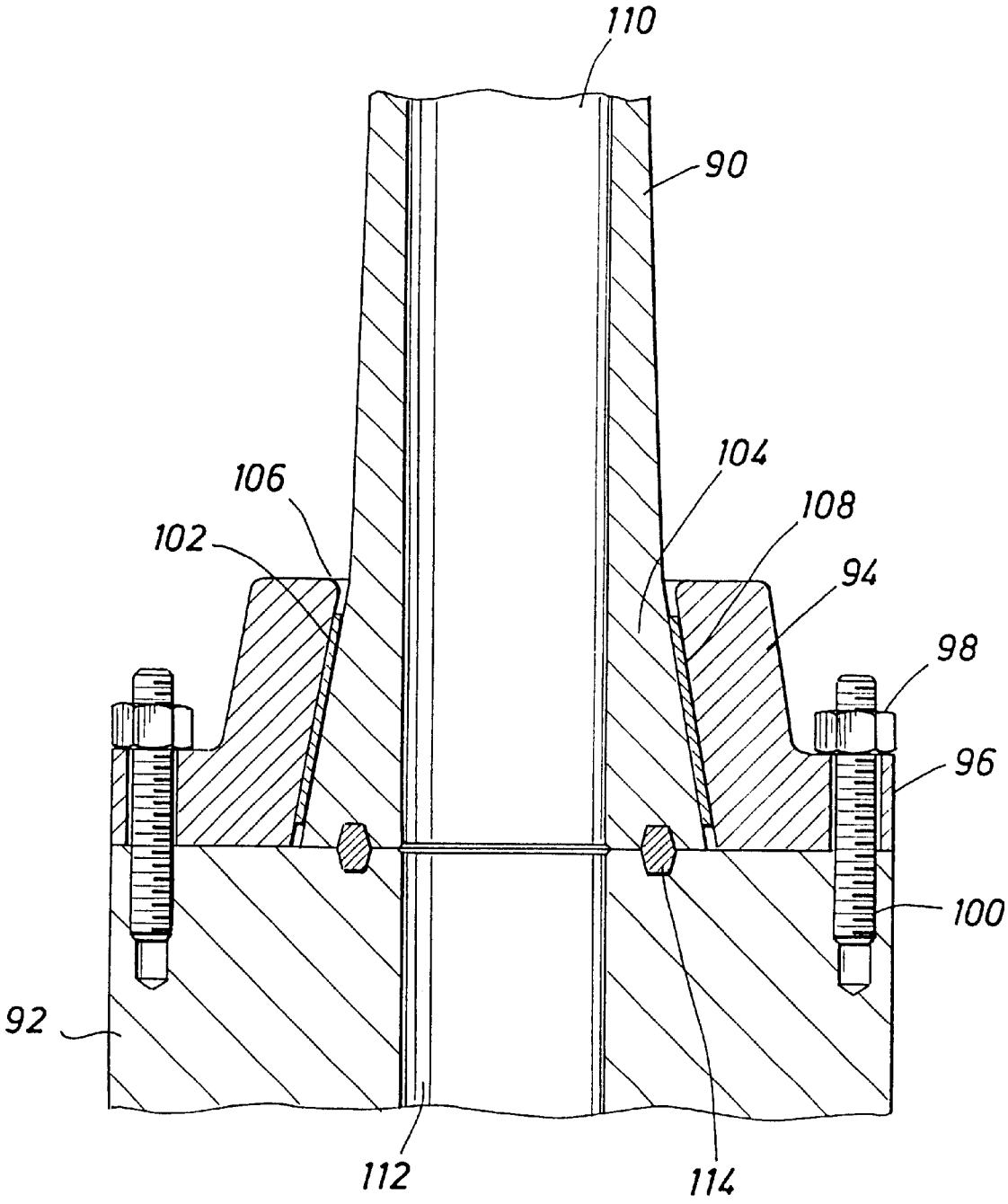
FIG. 7 is an elevational, cross-sectional view of another embodiment of the present invention showing the tieback connector supported at a subsea wellhead.

With reference now to FIG. 7, there is shown yet another embodiment of the present invention wherein a tubular member, e.g., a tieback 90, is attached to a wellhead 92. A socket 94 has a radially outwardly extending flange 96 that is secured to wellhead 92 via nut and bolt assemblies 98 that are threadedly received in threaded bores 100 in wellhead 92. Socket 94 has an inwardly facing frustoconical surface 102. Received in socket 94 is the lower end 104 of tieback 90, end 104 having a frustoconical outer surface 106 that is complementary to the frustoconical surface 102. Disposed between socket 94 and the surface 106 of tieback 90 is a sleeve 108, sleeve 108 being sandwiched between tieback 90 and socket 94. As can be seen, flow path 110 through tieback 90 is in register with a flow path 112 in wellhead 92, fluid-tight sealing between tieback 90 and wellhead 92 being accomplished by means of an annular fluid-tight seal 114.

As used herein, "titanium" includes titanium itself, as well as alloys thereof. Additionally, while the invention has been described primarily with reference to titanium elongate structural members being supported by steel support assemblies, it will be understood that it is not so limited.

The foregoing description and examples illustrate selected embodiments of the present invention. In light thereof, variations and modifications will be suggested to one skilled in the art, all of which are in the spirit and purview of this invention.

What is claimed is:

1. A mounting system for supporting elongate, metallic structural members subject to dynamic forces comprising:

a support assembly, said support assembly including a socket, said socket at least partially encircling said structural member;

an attachment for securing said support assembly to a positioned structure;

a sleeve received in said socket, said sleeve being disposed in surrounding relationship to said structural member, said sleeve comprising an electrically nonconductive, fiber-reinforced polymer composite having a through-thickness compressive strength above 25 ksi at temperatures at least as high as 120° C. and an S-N fatigue life under cyclic compressive through-thickness loading in excess of 1 million cycles at maximum compressive stress levels of ≦20 ksi.

2. The mounting system of claim 1 wherein said support assembly includes a bushing, said bushing being received in said socket.

3. The mount system of claim 2 wherein said sleeve is disposed between said structural member and said bushing.

4. The mount system of claim 1 wherein said sleeve is secured to said structural member.

5. The mounting system of claim 2 wherein said sleeve is sandwiched between said bushing and said structural member.

6. The mounting system of claim 1 wherein said structural member has a radially outwardly protruding flange and said bushing has a top surface and there is an annular bearing disposed between said flange and said top surface of said bushing, said bearing comprising an electrically nonconductive, fiber-reinforced polymer composite having a through-thickness compressive strength above 25 psi at temperatures at least as high as 120° C. and an S-N fatigue life under cyclic compressive through-thickness loading in excess of 1 million cycles at maximum compressive stress levels of ≦20 ksi.

7. The mounting system of claim 1 wherein said structural member comprises a section of a riser string.

8. The mounting system of claim 1 wherein said structural member comprises a portion of a tension leg.

9. The mounting system of claim 1 wherein said positioned structure comprises an offshore platform.

10. The mounting system of claim 1 wherein said positioned structure comprises an anchor.

11. The mounting system of claim 1 wherein said sleeve comprises a laminate of glass fibers in a polyether etherketone matrix.

12. The mounting system of claim 11 wherein said glass fibers are S-2 glass fibers and are present in an amount of 75% by weight.

* * * * *